US007438573B2

(12) United States Patent
Jao et al.

(10) Patent No.: US 7,438,573 B2
(45) Date of Patent: Oct. 21, 2008

(54) HINGE CONNECTOR FOR FOLDABLE ELECTRONIC APPARATUS

(75) Inventors: Chia Wei Jao, Taipei (TW); Hsi-Yung Liu, Taipei (TW)

(73) Assignee: Compal Communications Inc., Taipei (TW)

( * ) Notice: Subject to any disclaimer, the term of this patent is extended or adjusted under 35 U.S.C. 154(b) by 0 days.

(21) Appl. No.: 11/902,485

(22) Filed: Sep. 21, 2007

(65) Prior Publication Data

US 2008/0076270 A1 Mar. 27, 2008

(30) Foreign Application Priority Data

Sep. 21, 2006 (TW) ..... 95134914 A

(51) Int. Cl.
*H01R 3/00* (2006.01)

(52) U.S. Cl. ..... 439/165; 439/31; 361/681; 16/261

(58) Field of Classification Search ..... 439/31, 439/165; 361/681; 16/261
See application file for complete search history.

(56) References Cited

U.S. PATENT DOCUMENTS

| | | | | |
|---|---|---|---|---|
| 5,751,544 | A * | 5/1998 | Song | 361/681 |
| 5,951,312 | A * | 9/1999 | Horng | 439/165 |
| 7,017,233 | B2 | 3/2006 | Hsu et al. | |
| 7,097,479 | B2 * | 8/2006 | Lee | 439/165 |
| 7,100,239 | B2 | 9/2006 | Duan et al. | |
| 7,142,898 | B2 * | 11/2006 | Takagi | 455/575.3 |
| 2006/0005354 | A1 | 1/2006 | Nada et al. | |
| 2006/0285681 | A1 * | 12/2006 | Hsieh | 379/433.13 |

* cited by examiner

*Primary Examiner*—Tho D Ta
(74) *Attorney, Agent, or Firm*—Reed Smith LLP; Stanley P. Fisher, Esq.; Juan Carlos A. Marquez, Esq.

(57) ABSTRACT

The invention discloses a hinge connector installed in a foldable electronic apparatus. In particularly, the hinge connector according to the invention includes a hollow shaft device and a cable connecting connectors, and the cable passes through the shaft device.

6 Claims, 3 Drawing Sheets

HINGE CONNECTOR FOR FOLDABLE ELECTRONIC APPARATUS

BACKGROUND OF THE INVENTION

1. Field of the Invention

This invention relates to a hinge connector for a foldable electronic apparatus. More specifically, the invention relates to a hinge connector including a hollow shaft device and a cable passing through the shaft device.

2. Description of the Prior Art

Foldable structures are extensively used in consumer electrical appliances, such as mobile phones, PDAs, digital cameras, etc. A typical foldable electronic apparatus includes a main module and a folding module. The main module is composed of a first housing and a first electronic unit disposed in the first housing. The folding module is composed of a second housing and a second electronic unit disposed in the second housing.

In a so-called "foldable" electronic apparatus, the second housing is engaged to the first housing via a hinge connector. Further, the second housing is rotatable with respect to an axis or two axes of the first housing. By utilizing the hinge connector and a flexible conductive element (for instance, a flexible printed circuit board or a coaxial cable), the second electronic unit in the second housing can be electrically connected to the first electronic unit in the first housing.

The trend of minimization is an important design issue for current consumer electrical appliances. The usable space in an electronic apparatus is precious. However, most hinge connectors in prior arts are solid objects. There was not any prior art that discloses the idea of integrating the hinge connector and a flexible conductive element to increase the usable space as the invention does. With the manufacturing techniques in current days, the integrated components according to the invention can be precisely manufactured.

Accordingly, a scope of the invention is to provide a hinge connector for a foldable electronic apparatus. Specifically, the hinge connector includes a hollow shaft device and a cable passing through the shaft device.

SUMMARY OF THE INVENTION

A scope of the invention is to provide a hinge connector for a foldable electronic apparatus. The foldable electronic apparatus includes a first housing, a second housing, a first electronic unit, and a second electronic unit. The first electronic unit is disposed in the first housing. The second electronic unit is disposed in the second housing. The first housing includes a first knuckle and a second knuckle spaced from the first knuckle. The first knuckle has a recess. The first electronic unit includes a first connector disposed within the recess. The second housing includes a central knuckle aligned with the first knuckle and the second knuckle. The central knuckle has a cavity in communication with the recess. The second electronic unit includes a second connector.

The hinge connector includes a hollow sleeve device, a hollow shaft device, a third connector, a fourth connector, and a cable. The sleeve device is fitted in the cavity such that the sleeve device is rotatable together with the second housing with respect to the first housing. The hollow shaft device has a head end fitted in the recess such that the shaft device is rotatable together with the first housing with respect to the second housing. The shaft device is substantially and rotatably inserted through the sleeve device. The third connector is received at the head end of the shaft device and connected with the first connector. The fourth connector is connected with the second connector. The cable passes through the shaft device and electrically connects the third connector and the fourth connector.

Further, according to the invention, flexible conductive elements can be integrated in the hinge connector; the usable space in the electronic apparatus can be accordingly increased. The advantage and spirit of the invention may be understood by the following recitations together with the appended drawings.

BRIEF DESCRIPTION OF THE APPENDED DRAWINGS

DETAILED DESCRIPTION OF THE INVENTION

This invention provides a hinge connector for a foldable electronic apparatus. Specifically, the hinge connector includes a hollow shaft device and a cable passing through the shaft device. The embodiments according to the invention are described below to illustrate the characteristic, spirit, and advantage of the invention.

Figure 1:
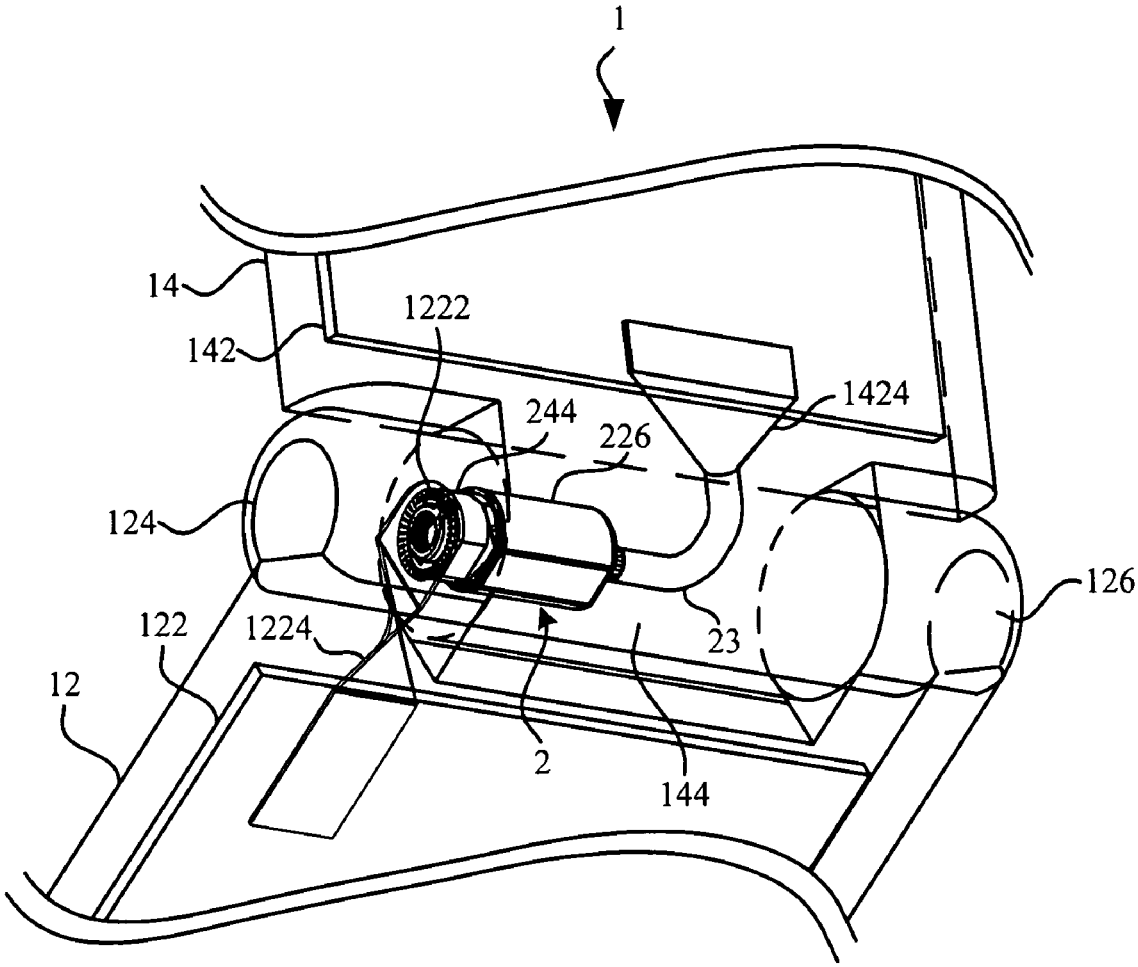
FIG. 1 shows the rear perspective of the foldable electronic apparatus in an embodiment according to the invention.

Please refer to FIG. 1, which shows the rear perspective of a foldable electronic apparatus 1 in an embodiment according to the invention. As shown in FIG. 1, the foldable electronic apparatus 1 includes a first housing 12, a second housing 14, a first electronic unit 122, and a second electronic unit 142.

The first electronic unit 122 is disposed in the first housing 12. The second electronic unit 142 is disposed in the second housing 14. The first housing 12 includes a first knuckle 124 and a second knuckle 126 spaced from the first knuckle 124. The first knuckle 124 has a recess (not shown in FIG. 1). The first electronic unit 122 includes a first connector 1222 disposed within the recess. The second housing 14 includes a central knuckle 144 aligned with the first knuckle 124 and the second knuckle 126. The central knuckle 144 has a cavity (not shown in FIG. 1) in communication with the recess. The second electronic unit 142 includes a second connector (not shown in FIG. 1).

Figure 2:
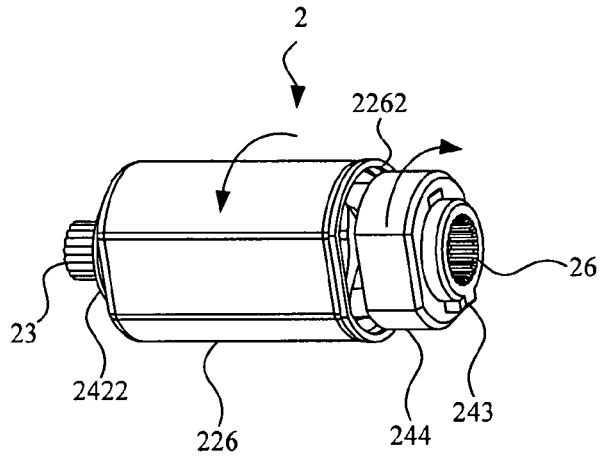
FIG. 2 illustrates the assembly view of the hinge connector in FIG. 1.
Figure 3:
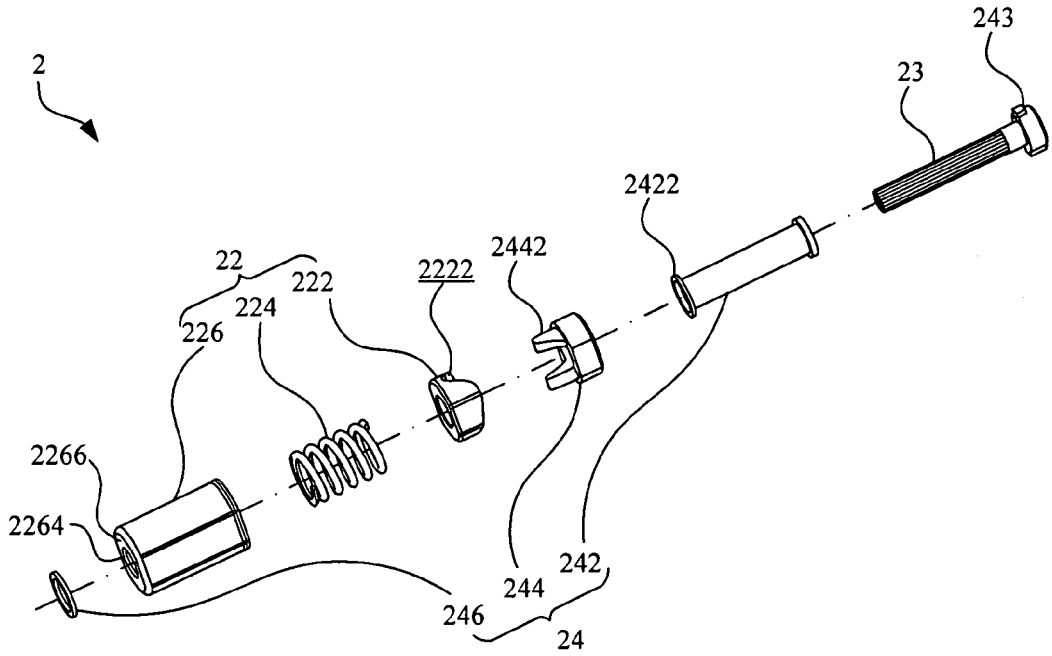
FIG. 3 illustrates the explosive view of the hinge connector in FIG. 2.

Please refer to FIG. 2 and FIG. 3. FIG. 2 illustrates the assembly view of the hinge connector 2 in FIG. 1; FIG. 3 illustrates the explosive view of the hinge connector 2 in FIG. 2. As shown in FIG. 2 and FIG. 3, the hinge connector 2 includes a hollow sleeve device 22, a hollow shaft device 24, a third connector 26, a fourth connector (not shown), and a cable 23.

As shown in FIG. 3, the sleeve device 22 is fitted in the cavity such that the sleeve device 22 is rotatable together with the second housing 14 with respect to the first housing 12. Also as shown in FIG. 3, the hollow shaft device 24 has a head end 243 fitted in the recess such that the shaft device 24 is rotatable together with the first housing 12 with respect to the second housing 14. Further, the shaft device 24 is substantially and rotatably inserted through the sleeve device 22.

Figure 4:
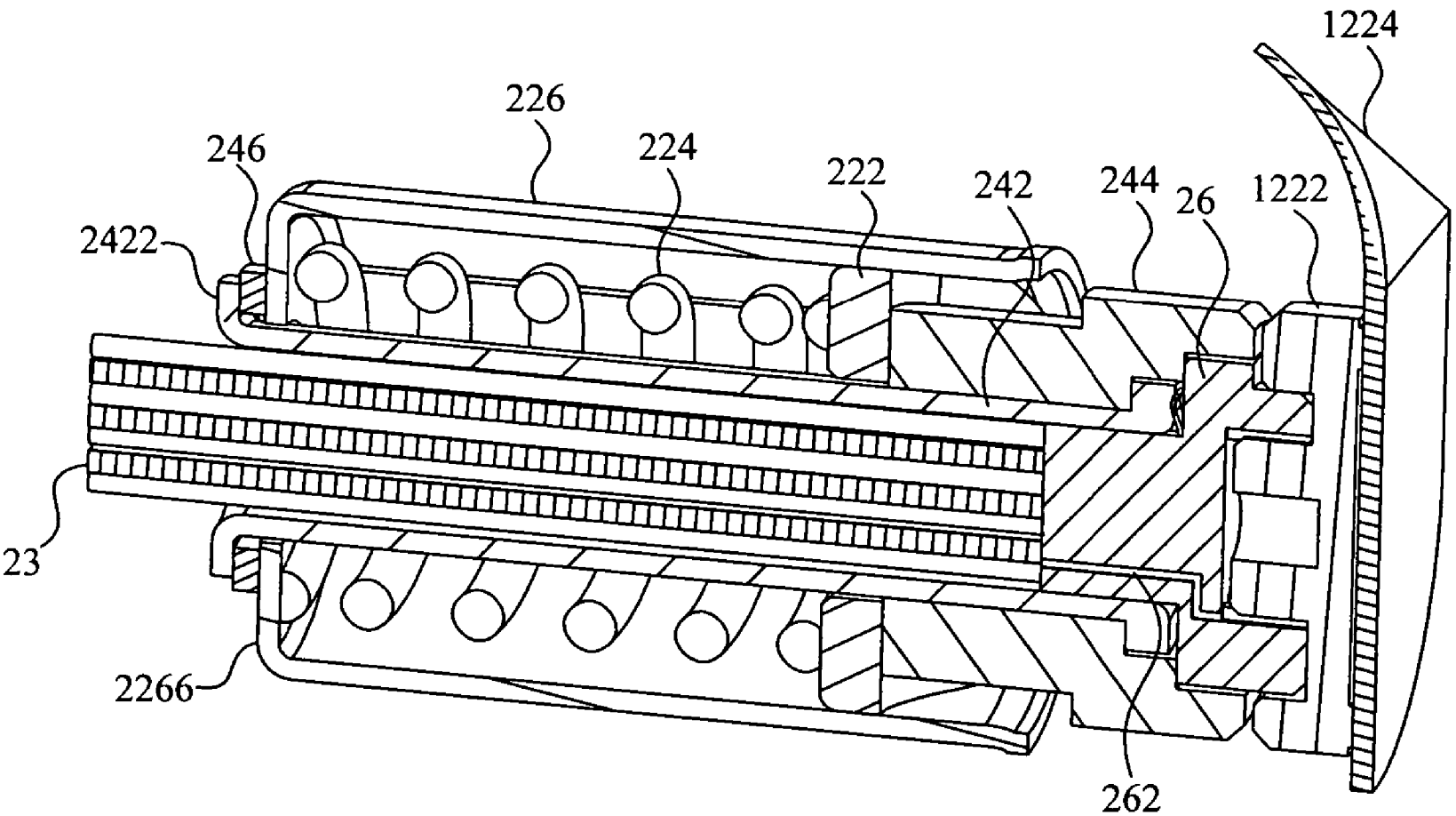
FIG. 4 shows the sectional assembly view of the hinge connector and the third connector in an embodiment according to the invention.

Please refer to FIG. 4, which shows the sectional assembly view of the hinge connector and the third connector 26 in an embodiment according to the invention. As shown in FIG. 4, the third connector 26 is received at the head end 243 of the shaft device 24 via a flexible conductive element 1224 and connected with the first connector 1222. The fourth connector is connected with the second connector via a flexible conductive element 1424. The cable 23 passes through the shaft device 24 and electrically connects the third connector 26 and the fourth connector. In actual applications, the flexible conductive elements 1224 and 1424 can be electronic devices conforming to the industrial specification without special designs or special manufacturing processes.

In this embodiment, the shaft device 24 includes a hollow shaft 242 and a hollow cam 244. The hollow cam 244 has a cam tip 2442 and is engaged to the shaft 242 to provide the head end 243 of the shaft device 24.

Moreover, in this embodiment, the sleeve device 22 includes a hollow cam follower 222, a spring 224, and a sleeve 226. The cam follower 222 is fitted on the shaft 242 and has a cam surface 2222 arranged to limitedly slide on the cam tip 2442 of the cam 244. The spring 224 is fitted on the shaft 242 and urges against the cam follower 222. The sleeve 226 has an opening 2262 at one end thereof, an aperture 2264 at the other end thereof, and a shoulder 2266 surrounding the aperture 2264. The sleeve 226 receives the cam follower 222, and the spring 224 also urges against the interior of the shoulder 2266 of the sleeve 226.

Furthermore, in this embodiment, the shaft 242 has a flange 2422 at a distal end thereof. The shaft device 24 further includes a retainer 246 fitted on the shaft 242; the retainer 246 is disposed between the exterior of the shoulder 2266 of the sleeve 226 and the flange 2422 of the shaft 242 to prevent the sleeve 226 from falling off. In actual applications, the retainer 246 can be a washer or a C-ring.

In an embodiment, the shaft 242 is formed of a metal material, and the third connector 26 has a metal enclosure 262 contacting the interior of the shaft 242 to prevent the hinge connector 2 from electrostatic discharge (ESD).

As described above, the hinge connector 2 includes a hollow shaft device 24 and cable 23 passing through the shaft device 24. It can be seen that the hinge connector 2 has few components and is easy to be assembled. Therefore, the manufacturing cost of the whole foldable electronic apparatus 1 can be reduced. In addition, according to the invention, flexible conductive elements can be integrated in the hinge connector; the usable space in the electronic apparatus is accordingly increased.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A hinge connector for a foldable electronic apparatus comprising a first housing, a second housing, a first electronic unit disposed in the first housing, and a second electronic unit disposed in the second housing, the first housing comprising a first knuckle and a second knuckle spaced from the first knuckle, the first knuckle having a recess, the first electronic unit comprising a first connector disposed within the recess, the second housing comprising a central knuckle aligned with the first knuckle and the second knuckle, the central knuckle having a cavity in communication with the recess, the second electronic unit comprising a second connector, said hinge connector comprising:

a hollow sleeve device, fitted in the cavity such that the sleeve device is rotatable together with the second housing with respect to the first housing;

a hollow shaft device having a head end fitted in the recess such that the shaft device is rotatable together with the first housing with respect to the second housing, the shaft device being substantially and rotatably inserted through the sleeve device;

a third connector, being received at the head end of the shaft device and connected with the first connector;

a fourth connector, connected with the second connector; and a cable, passing through the shaft device and electrically connecting the third connector and the fourth connector.

2. The hinge connector of claim 1, wherein the shaft device comprises:

a hollow shaft; and a hollow cam, having a cam tip and being engaged to the shaft to provide the head end of the shaft device.

3. The hinge connector of claim 2, wherein the sleeve device comprises:

a hollow cam follower, fitted on the shaft and having a cam surface arranged to limitedly slide on the cam tip of the cam;

a spring, fitted on the shaft and urging against the cam follower; and a sleeve, having an opening at one end thereof, an aperture at the other end thereof, and a shoulder surrounding the aperture, the sleeve receiving the cam follower, and the spring also urging against the interior of the shoulder of the sleeve.

4. The hinge connector of claim 3, wherein the shaft has a flange at a distal end thereof, and the shaft device further comprises a retainer disposed between the exterior of the shoulder of the sleeve and the flange of the shaft to prevent the sleeve from falling off.

5. The hinge connector of claim 4, wherein the retainer is a washer or a C-ring.

6. The hinge connector of claim 3, wherein the shaft is formed of a metal material, and the third connector has a metal enclosure contacting the interior of the shaft to prevent ESD.

* * * * *